United States Patent [19]

Yamada

[11] 3,941,243

[45] Mar. 2, 1976

[54] RAZOR BLADE CONTAINER FOR SINGLE EDGE BLADES FOR USE IN STRAIGHT EDGE TYPE RAZOR

[76] Inventor: Katsumi Yamada, No. 28, 2-chome, Kasuga-cho, Seki, Gifu Prefecture, Japan

[22] Filed: Feb. 27, 1975

[21] Appl. No.: 553,549

[30] Foreign Application Priority Data

Sept. 9, 1974 Japan ..... 49-103645

[52] U.S. Cl. ..... 206/359; 206/356; 221/58

[51] Int. Cl.[2] ..... B65D 83/10

[58] Field of Search ..... 206/359, 360, 354, 355, 206/356, 357, 358; 30/40.1, 40.2, 32, 40; 221/29, 152, 40, 41, 58, 59, 270, 279, 232

[56] References Cited

UNITED STATES PATENTS

| | | | |
|---|---|---|---|
| 1,806,087 | 5/1931 | Schick | 206/356 |
| 2,641,358 | 6/1953 | Santo | 206/359 |
| 2,653,704 | 9/1953 | Nelson | 206/355 |
| 2,684,151 | 7/1954 | Arrighi | 206/355 |
| 2,976,986 | 3/1961 | Linn | 206/356 |
| 3,244,317 | 4/1966 | Raybin | 221/58 |

*Primary Examiner*—William Price
*Assistant Examiner*—Joseph M. Moy
*Attorney, Agent, or Firm*—Wenderoth, Lind & Ponack

[57] ABSTRACT

A blade container for single edge blades for a straight edge type razor with a replacable blade held in a blade holder. The container has a blade attaching slot in one end wall adjacent one side wall for receiving the end of the blade holder, and a blade detaching slot in one end wall adjacent the other side wall and having a blade retaining projection therein on the side of said slot away from the other side wall. A blade attaching slider is slidable along the container toward and away from the blade attaching slot and a blade compartment therein extending between the side walls in which blades are movable in a direction from one side wall to the other. A blade support and guide within the container adjacent the blade detaching slot is spring urged in a direction through the compartment for urging blades in the compartment toward the side wall adjacent the blade attaching slot and guides a blade holder toward the side wall adjacent the blade attaching slot and behind the blade retaining projection.

4 Claims, 15 Drawing Figures

RAZOR BLADE CONTAINER FOR SINGLE EDGE BLADES FOR USE IN STRAIGHT EDGE TYPE RAZOR

The present invention relates to a blade container for single edge razor blades for a straight edge type razor having a replacable blade and by the use of which a used blade can be exchanged for a new one safely and speedily and which at the same time provides safe storage of used blades within the said container.

BACKGROUND OF THE INVENTION

The conventional type of single edge blade 32 for a straight edge type razor having a replacable blade has the blade edge covered with a protecting paper 33 such as a paper tape or the like as shown in FIG. 15, and is placed in a container of a plurality of such blades. After taking a blade out of the said container and removing the protecting paper 33, the blade is attached to a blade support by hand. This is very dangerous because a finger tip might slip or an awkward manipulation may be required. Moreover, a far greater danger exists when a used blade is disposed of carelessly by being thrown away into a waste basket or the like.

OBJECTS AND SUMMARY OF THE INVENTION

An object of the present invention is to provide a razor blade container by means of which a new blade can be attached to a razor blade support of the razor into a slot therein and operating a pawl a used blade can be removed from the blade support of the razor by inserting the support into the container and pulling it out again.

Another object of the present invention is to provide a razor blade container in which new blades are kept separate from used blades in the blade compartment.

These objects are achieved by the container of the present invention, in which a blade attaching slot and a blade detaching slot which is provided with a blade detaining part are arranged on opposite ends of the container, and a pawl guide groove and a stop guide groove are provided in the container parallel to the longitudinal direction thereof and in the upper and the side surfaces thereof along the side corresponding to the blade attaching slot. A blade attaching slider is disposed with a pawl and a stop slidably positioned with respective grooves and a blade support guide having a curved guide portion in the interior of the container along the side adjacent the blade detaching slot and is braced by spring means toward the side of the container along which the guide grooves run. A partition within the interior and movable from the side adjacent the blade detaching opening to the side along which the grooves run acts as a divider between new and used blades. The removing of a used blade from and the attaching of a new blade to the razor are respectively completed by inserting the blade support into the blade detaching slot and into the blade attaching slot.

BRIEF DESCRIPTION OF THE DRAWINGS

The invention will now be described in greater detail with reference to the accompanying drawings, in which.

Figure 1:
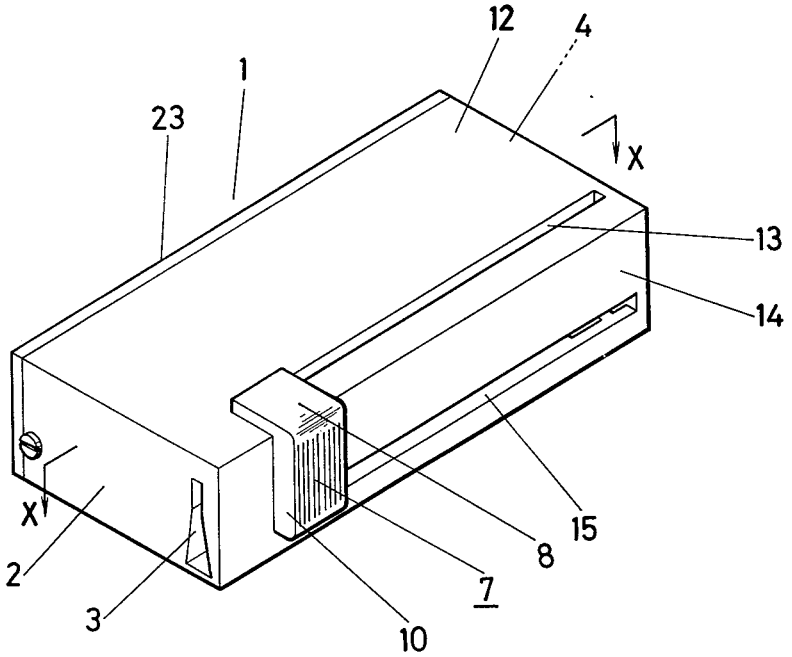
FIG. 1 is a perspective view of the container according to the present invention.
Figure 2:
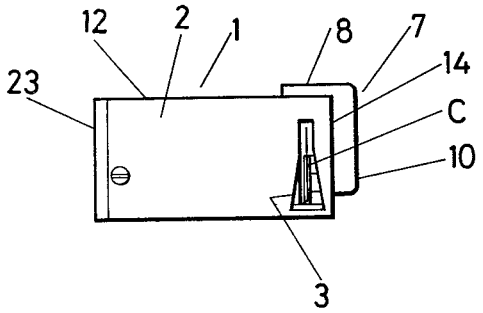
FIG. 2 is a left end view of the container of FIG. 1.
Figure 3:
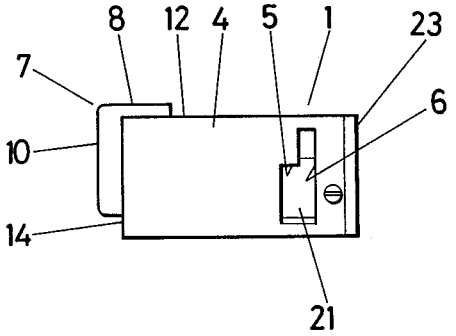
FIG. 3 is a right end view of the container of FIG. 1.
Figure 4:
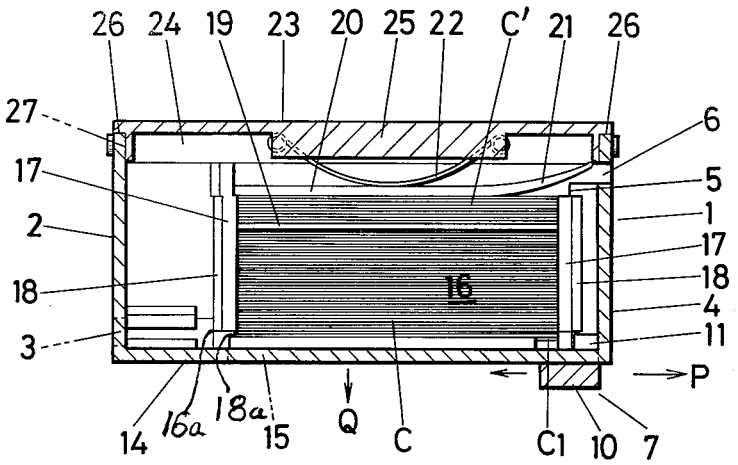
FIG. 4 is a sectional plan view of the container of FIG. 1.
Figure 5:
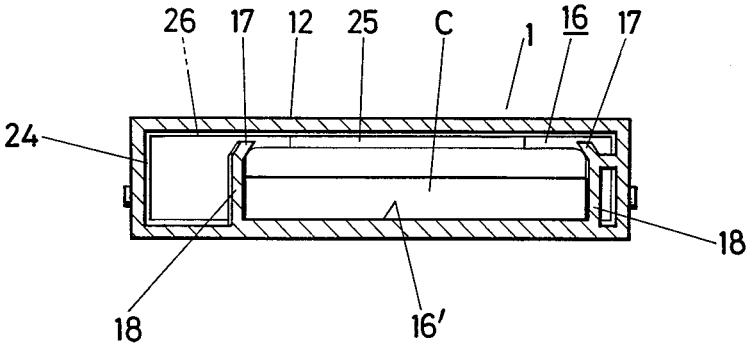
FIG. 5 is a longitudinal sectional view taken substantially along Line X—X of FIG. 1.

DETAILED DESCRIPTION OF THE INVENTION:

In the blade container 1 according to the present invention, a blade attaching slot 3 having a shape the same as that of the cross section of a blade support B of a straight edge type razor A having a replacable blade, is, as shown in FIGS. 1 and 2, provided in one end surface 2 of either one of two opposing end surfaces of the container 1 and adjacent one side 14 of the container. A blade detaching slot 6 is provided in the end surface 4 opposite to the end surface 2 having the foregoing blade attaching slot 3, as shown in FIGS. 3 and 4, and is disposed adjacent the other side 23 of the container 1. A blade retaining projection 5 projects into the blade detaching slot 6 on the side thereof away from the container side 23. The dimension of slot 6 in the direction between the top 12 and the bottom of the container is sufficient to receive the blade holder B with a used blade C′ therein. The portion of the slot 6 between the end of projection 5 and the other end of the slot has a dimension sufficient only to receive the blade holder B, so that when the blade holder B with a used blade C′ therein is engaged behind projection 5, and the blade holder B is withdrawn from the slot, used blade C′ will be pulled from the blade support B.

Figure 6:
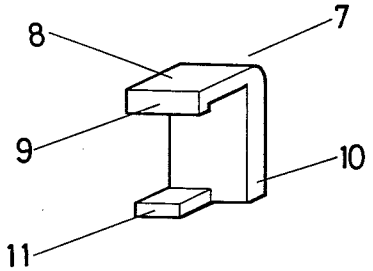
FIG. 6 is a perspective view of a blade attaching slider.

A blade attaching slider 7 has, as shown in FIGS. 1 and 6, a cross-section with an inverted L-shape and has a guide pawl 9 perpendicularly depending from the free end of the entire width of an upper member 8. The slider 7 has a blade ejecting pawl 11 extending perpendicularly to the interior side of a lower member 10 and parallel to the said upper member 8. The said blade attaching slider 7 is, as shown in FIG. 1, slidable along the top 12 and adjacent one side 14 of the container 1, the said guide pawl 9 fitting into a guide groove 13 which is disposed near the one side of the top surface 12 of said container 1, and the inner end of the said blade ejecting pawl 11 passing through a guide groove 15 in the one side 14 and projecting into the interior of the container 1.

A blade compartment 16 is formed by a pair of partitions 18 extending from one side 14 to the other side 23 of the container and spaced a distance to hold and laterally feed blades C. A bent flange 17 bent toward the direction of the said compartment 16 is at a level higher than the bottom of the said blade attaching slot 3. A blade ejecting aperture **18*a* is provided in partition 18 toward the end 2 at a position opposite the blade attaching opening 3. A step 16*a* is formed between the bottom of the container and bottom 16′ adjacent said aperture 18*a*** so that the tip of an inserted blade support can be securely abutted thereagainst.

A divider 19 is provided in compartment 16 to separate new blades C and used blades C′ and the foremost new blade C is positioned in alignment with aperture 18*a* in the path of movement of the pawl 11, as shown in FIG. 4.

A blade support guide 20 is provided at the back of the compartment 16 adjacent the blade detaching aperture 6, and has a curved guide portion 21 on the end thereof toward the aperture 6 which curves from the back of the compartment 16 across the aperture 6. When a blade holder B with a used blade C′ therein is inserted into aperture 6, the curved portion 21 guides the blade holder B forward, laterally of the aperture 6 until it lies behind as viewed from outside the end 4 of the container the projection 5 and the used blade C′ is against the rearmost used blade in the compartment 16. As shown in FIG. 4, a plate spring 22 engages the blade guide 20 to urge it towards the blade compartment 16, and is held by a block 25 on side 23. A rectangular flange 24 projects inwardly from the side 23. The flange 24 on side 23 is securely fitted into the opening defined by the inner surfaces of the ends 2 and 4 and the flange 26 around the outside circumference of the side 23 engages the edges of ends 2 and 4 and the top and bottom.

Figure 7:
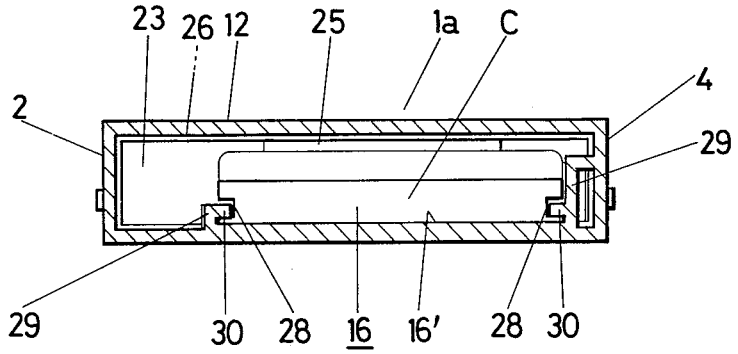
FIG. 7 is a longitudinal sectional view similar to that of FIG. 5 showing another embodiment of the internal structure of the container.

FIG. 7 shows another embodiment wherein notches 28 are provided at the bottom of the blade C at both ends thereof and the container 1*a* has flanges 30 opposed to each other and at a right angle to respective partitions 29 so as to engage in the notches 28 so that the blades C slide along the notches.

Figure 8:
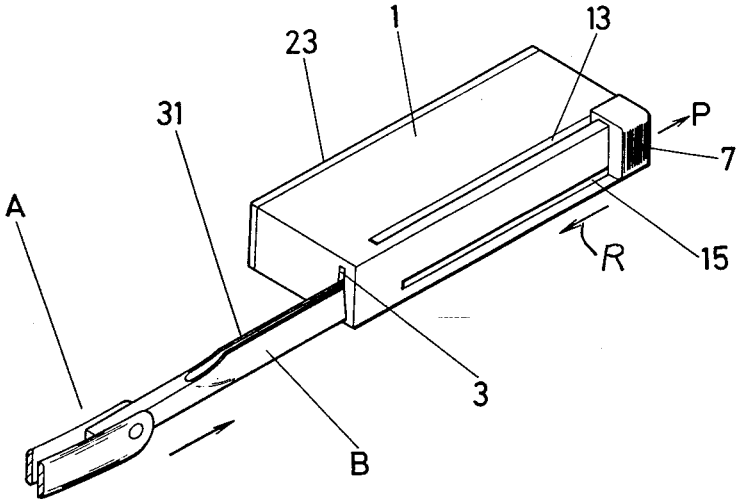
FIGS. 8–11 are views showing the steps of attaching a new blade to a blade support.

For mounting a blade C in the blade support B of the safety razor A which is provided with a groove 31 for inserting the said blade C, the blade attaching slider 7 is first moved away from the slot 3, as shown in FIG. 8, in the direction indicated by the arrow P along the guide groove 13 and the guide groove 15, then the pawl 11 of the slider 7 disengages, as shown in FIG. 4, from the rear end of the foremost blade C in the blade compartment 16 when the said pawl 11 moves past the rear end of the said foremost blade C.

Figure 9:
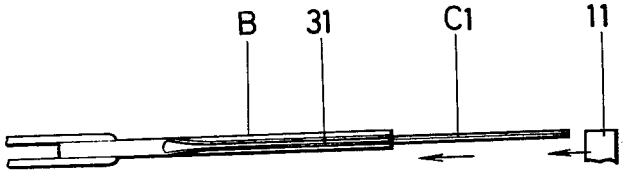
Figure 10:
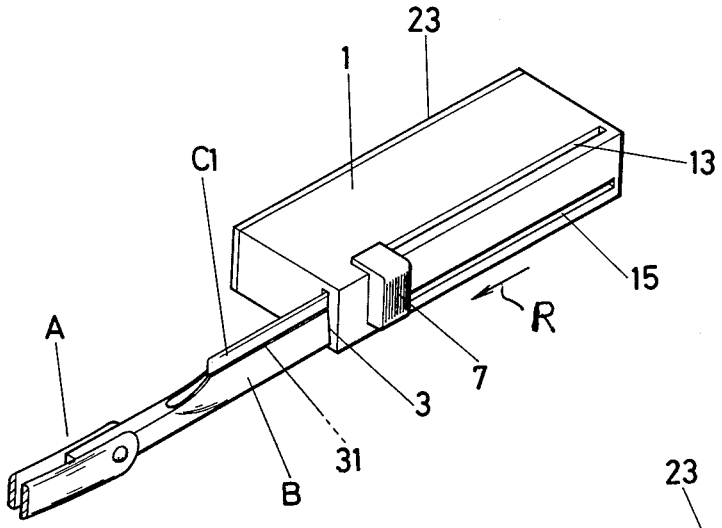
Figure 11:
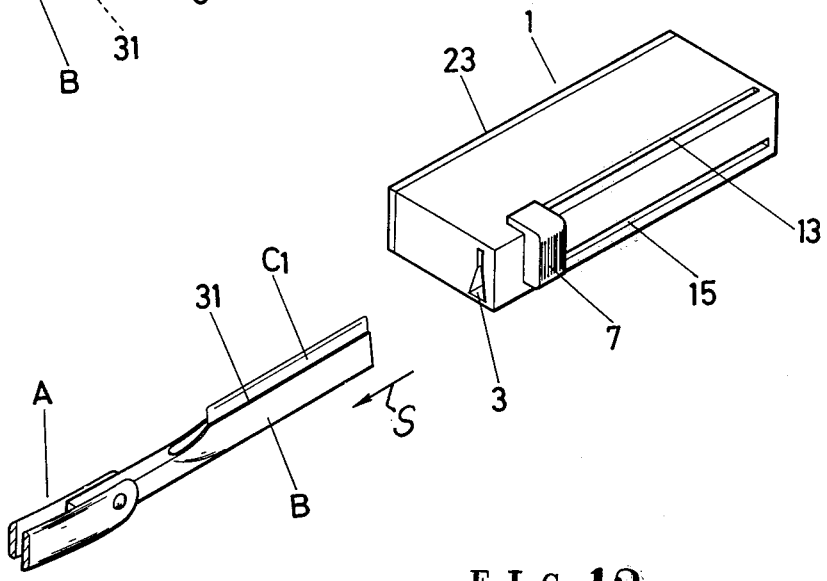

At this moment, the foremost blade C is pressed together with the rest of the succeeding blades C in the direction of arrow Q due to the force exerted by the plate spring 23, and therefore, the rear end of the foremost blade C is displaced into the path of the pawl 11 while moving in the same direction as the rest of the succeeding blades. When the forward end of the blade support B of the razor A is, as shown in FIG. 8, inserted into the blade attaching slot 3 of the container 1, the lower tip end of the said blade support B is securely positioned by engagement with step 16*a* and simultaneously the tip end of the said support B and the forward end of the foremost blade C come into contact with each other, as shown in FIG. 9. While the blade support B is held fixed in this position, the blade attaching slider 7 is pushed in the direction of arrow R, as shown in FIG. 10. Consequently, the foremost blade C, the rear end of which is engaged by the tip of the pawl 11, is, as shown in FIG. 10, inserted into the groove 31 of the said blade support B, which, as shown in FIG. 9, lies in the direction of the movement of the said foremost blade C. Insertion of the said blade C is, as shown in FIG. 11, completed by pulling the said support B out of the said slot 3 in the direction of arrow S.

Figure 12:
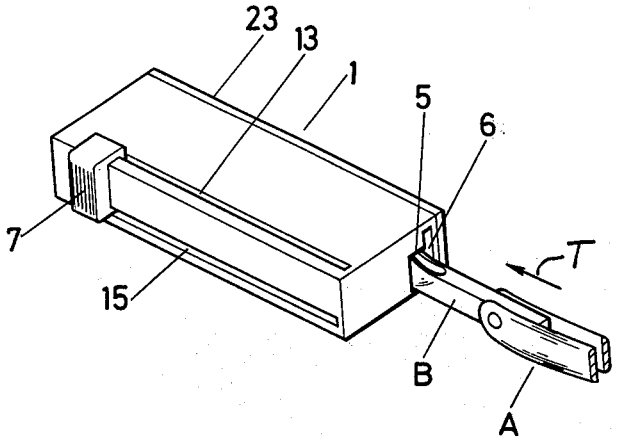
FIGS. 12–14 are views showing the steps for removing a used blade from the blade support.
Figure 13:
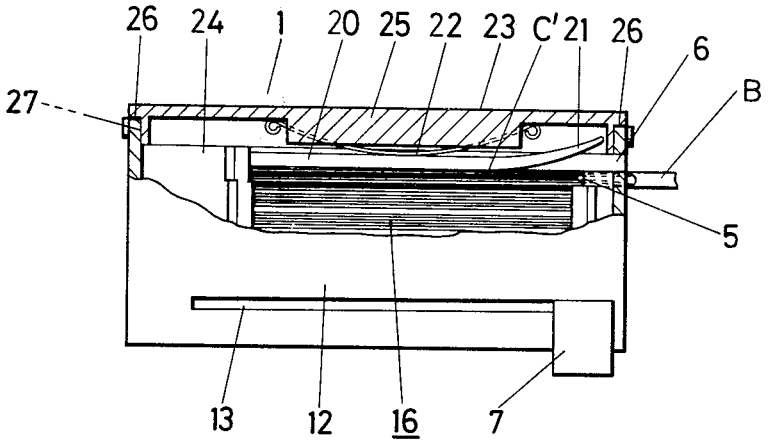
Figure 14:
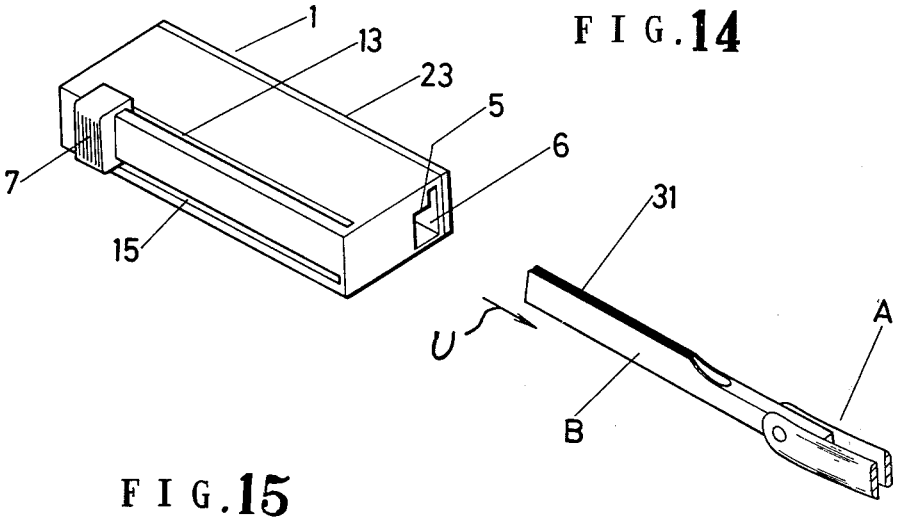
Figure 15:
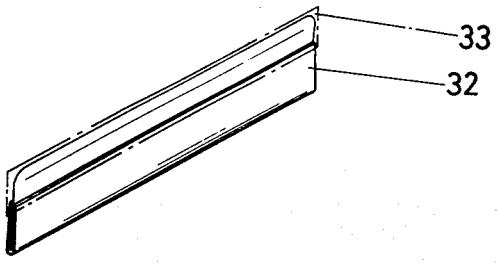
FIG. 15 is a perspective view of a conventional blade.

For removing a used blade C′, the forward end of the blade support B, having the blade thereon, is inserted into the blade detaching slot 6 in the direction of arrow T, and the force exerted by the plate spring 22 holds guide 20 so that the curved guide portion 21, which is across the said blade detaching slot 6 diverts the straight advancement of the blade support B so that the blade support B is pushed towards the blade compartment. At the moment the entire portion of the blade support B is inside the container, the base part of the said blade support B is, as shown in FIGS. 12 and 13, pushed behind the blade retaining projection 5 and the used blade C′ remains within the blade compartment 16 having been retained by the said projection 5 when the support B is, as shown in FIG. 14, pulled out of slot 6 in the direction of arrow U to complete removing of the used blade C′.

In this way, by repeating the manipulations just described above, the attaching of a new blade C and the removing of a used blade C′ can be performed.

With this invention, because the new blade is attached and the used blade is removed within the container, the attaching and removing operation can be performed safely and speedily and, moreover, the used blade being securely collected within the said container, it is extremely safe. The pawl on the blade attaching slider extends into the interior of the container through the guide groove which is longitudinally disposed in alignment with the blade attaching slot so that, by means of this pawl, the blades can be fed into the groove of the blade support one by one securely pushing each blade.

Also, in the present invention, the blade detaching slot, which has the blade retaining projection, is on the opposite end of the container so that the used blade can be easily and surely drawn out of the groove of the blade support. Moreover, the number of blades required for maintaining a desired compression of the plate spring is always present within the blade compartment, and the attaching of the blade to the blade support can be securely performed by applying a uniform pressure being exerted by the said spring on the blade support guide and each blade.

Further, in the present invention, the divider 19 is placed between the new blades and the used blades so that a shortage of new blades can be easily observed and, furthermore, improper reuse of the used blades can be avoided.

What is claimed is:

1. A blade container for single edge blades for a straight edge type razor with a replacable blade held in a blade holder, said container having opposite end walls, opposite side walls and top and bottom walls, said container having a blade attaching slot in one end wall adjacent one side wall for receiving the end of the blade holder, said container having a blade detaching slot in one end wall adjacent the other side wall and having a blade retaining projection in said blade detaching slot on the side of said slot away from said other side wall, a blade attaching slider slidable along said container toward and away from said blade attaching slot, said container having a blade compartment therein extending between said side walls in which blades are movable in a direction from one side wall to the other, said blade attaching slider having a pawl thereon projecting into said blade compartment for engaging a blade and moving it toward said blade attaching slot in alignment with a blade holder inserted thereinto, and blade support and guide means within said container adjacent said blade detaching slot spring urged in a direction through said compartment for urging blades in said compartment toward said side wall adjacent said blade attaching slot and having a shape for guiding a blade holder toward said side wall adjacent said blade attaching slot.

2. A blade container as claimed in claim 1 in which said blade attaching slot and said blade detaching slot are in opposite ends of said container.

3. A blade container as claimed in claim 1 in which said blade support and guide means comprises a blade support member extending along the end of said blade compartment adjacent said blade detaching slot and a guide portion curving from the end thereof toward said blade detaching slot across said blade detaching slot for guiding the blade holder and used blade into said container and behind, when viewed from outside the end of the container having the blade detaching slot therein, behind the blade retaining projection, whereby when the blade holder is withdrawn from the container, the used blade is retained in the container by the blade retaining projection.

4. A blade container as claimed in claim 1 in which said blade compartment has a divider therein movable through the blade compartment in the same direction as the blades for separating new blades from used blades.

* * * * *